US006077215A

United States Patent [19]

Leysieffer

[11] Patent Number: 6,077,215

[45] Date of Patent: Jun. 20, 2000

[54] METHOD FOR COUPLING AN ELECTROMECHANICAL TRANSDUCER OF AN IMPLANTABLE HEARING AID OR TINNITUS MASKER TO A MIDDLE EAR OSSICLE

[75] Inventor: Hans Leysieffer, Taufkirchen, Germany

[73] Assignee: Implex GmbH Spezialhorgerate, Ismaning, Germany

[21] Appl. No.: 09/168,079

[22] Filed: Oct. 8, 1998

[51] Int. Cl.[7] ..... H04R 25/00

[52] U.S. Cl. ..... 600/25

[58] Field of Search ..... 600/25; 128/898; 607/55, 56, 57; 623/10

[56] References Cited

U.S. PATENT DOCUMENTS

| | | | |
|---|---|---|---|
| 4,281,419 | 8/1981 | Treace | 623/10 |
| 4,817,607 | 4/1989 | Tatge | 623/10 |
| 5,220,918 | 6/1993 | Heide et al. | 600/25 |
| 5,325,872 | 7/1994 | Westermann | 128/897 |
| 5,498,226 | 3/1996 | Lenkauskas | 600/25 |
| 5,624,376 | 4/1997 | Ball et al. . | |
| 5,788,711 | 8/1998 | Lehner et al. | 600/25 |
| 5,795,287 | 8/1998 | Ball et al. | 600/25 |
| 5,836,863 | 11/1998 | Bushek et al. | 600/25 |
| 5,842,967 | 12/1998 | Kroll | 600/25 |
| 5,941,814 | 8/1999 | Lehner et al. | 600/25 |

OTHER PUBLICATIONS

John M. Fredrickson, M.D., et al., Ongoing Investigations into an Implantable Electromagnetic Hearing Aid for Moderate to Severe Sensorineural Hearing Loss, Otolaryngologic Clinics of North Ameria, vol. 28, No. 1, Feb. 1995, pp. 107–120.

Th. Lenarz B.P., et al., Vibrant Soundbridge System: EIN Neuartiges Hörimplantat FüInnenohrschwerhörige Laryngo–Rhino–Otel. 77 (1998) pp. 247–255.

*Primary Examiner*—John P. Lacyk
*Assistant Examiner*—Joseph Cadugan
*Attorney, Agent, or Firm*—Nixon Peabody LLP; David S. Safran

[57] ABSTRACT

A method for coupling an electromechanical transducer of a partially or totally implantable hearing aid and/or tinnitus masker to a middle ear ossicle of a hearing impaired person which is to be stimulated. The hearing aid and/or tinnitus masker includes the electromechanical transducer, a transducer positioning and fixing device, and an elongated coupling rod driven by the transducer, the elongated coupling rod having a tip. The method of the present invention includes performing a mastoidectomy to provide a mastoid cavity adapted for receiving the hearing aid and/or tinnitus masker transducer, passing the coupling rod through the natural passage of the aditus ad antrum, positioning and fixing the hearing aid and/or tinnitus masker transducer within the mastoid cavity with the elongated coupling rod passing through the aditus ad antrum, and contacting the tip of the elongated coupling rod with the ossicle to be stimulated.

12 Claims, 2 Drawing Sheets

METHOD FOR COUPLING AN ELECTROMECHANICAL TRANSDUCER OF AN IMPLANTABLE HEARING AID OR TINNITUS MASKER TO A MIDDLE EAR OSSICLE

BACKGROUND OF THE INVENTION

1. Field of the Invention

The invention relates to a method for coupling an electromechanical transducer of a hearing aid or a tinnitus masker to a middle ear ossicle of a hearing impaired person.

2. Description of Related Art

Disorders of the inner or middle ear comprise the most common reason for impairments of hearing. In addition thereto, an increasing number of patients complain about a ringing, whistling or buzzing noise in the head which has no external source, a condition known as tinnitus. In recent years, it has been found that tinnitus may be alleviated or even overcome by providing the patient with a noise signal, for example white narrow band noise, which masks the noise caused by tinnitus.

One approach to overcome the above problems is to provide the patient with a hearing aid and/or tinnitus masker that is fixed to the external ear. However, this approach has several fundamental disadvantages, amongst which are to be named: (1) stigmatization of the patient; (2) the sound is often found to be unsatisfactory due to the limited frequency range and undesired distortion; (3) in many patients the ear canal fitting device leads to an occlusion effect; (4) acoustic feedback when amplification is high.

In view of the above disadvantages of such external hearing aids, John M. Fredrickson et al proposed in "Ongoing Investigations Into An Implantable Electromagnetic Hearing Aid For Moderate To Severe Sensorineural Hearing Loss", Otolaryngologic Clinics Of North America, volume 28, No. 1, February 1995, an implantable middle ear transducer which comprises an electromagnetic motor housed in a hermetically sealed case, where the motor drives a biocompatible elongated probe having a probe tip which is placed in a laser ablated hole in the body of the incus.

In the process of implanting the transducer as described in the above journal article for implantation of the said transducer in the rhesus monkey, a postauricular incision approximately 2 cm behind the external auditory canal is made. The temporalis muscle is transected posteriorly and is reflected anteriorly. An 8.5 mm trephine is used to define the mastoid landmark for an atticotomy approach designed to expose the body of the incus. During the atticotomy, the posterior wall of the bony external auditory canal is thinned, the middle fossa dural plate is exposed, and the incus and incudomalleolar joint are identified. Then a second hole is drilled anteriorly at the root of the zygoma to facilitate probe tip-incus coupling during implantation.

Another partially implantable hearing aid system by Symphonix Devices, Inc., USA uses a "floating mass transducer" (FMT) for directly driving the ossicular chain of a hearing impaired patient with a sensorineural hearing loss (G. R. Ball et al.: Implantable and external hearing systems having a floating mass transducer, U.S. Pat. No. 5,624,376). The FMT is attached to the long process of the incus with a titanium clip using special surgical instruments. The dimensions of the FMT are 1.8 mm in diameter and 2.3 mm in length. After a mastoidectomy, a posterior tympanotomy has to be performed through the facial nerve recess to introduce the FMT into the middle ear cavity and to fix it to the incus (Th. Lenarz et al in "Vibrant Soundbridge System: Ein neuartiges Hörimplantat für Innenohrschwerhörige, Teil 1: Funktionsweise und erste klinische Erfahrungen", Laryngo-Rhino-Otol. 77(1998), 247–255). This procedure inheres a relatively great risk of injuring the adjacent facial nerve.

Both methods described above of directly coupling an implantable hearing aid transducer to the ossicular chain involve an extensive amount of invasive measures with risks of injury of the middle ear, inner ear, and especially the facial nerve.

SUMMARY OF THE INVENTION

It is therefore an object of the present invention to provide a method for coupling to a middle ear ossicle to be stimulated, an electromechanical transducer of a partially or totally implantable hearing aid and/or tinnitus masker comprising said transducer, transducer positioning and fixing means and an elongated coupling rod driven by said transducer and having a tip, where the the method involves less invasive steps and thus, less risks of middle ear, inner ear or facial nerve impairments.

To achieve this object, the invention provides for a method for coupling to a middle ear ossicle to be stimulated, an electromechanical transducer of a partially or totally implantable hearing aid and/or tinnitus masker comprising said transducer, transducer positioning and fixing means and an elongated coupling rod driven by said transducer and having a tip, the method comprising:

performing a mastoidectomy to provide a mastoid cavity adapted for receiving said hearing aid and/or tinnitus masker transducer;

passing the transducer coupling rod through the natural passage of the aditus ad antrum connecting said mastoid cavity with the tympanic cavity;

fixing the hearing aid and/or tinnitus masker transducer within said mastoid cavity with the elongated coupling rod passing through said passage; and contacting the tip of the coupling rod with the ossicle to be stimulated.

In the method of the invention, the bony wall of the tympanic cavity thus remains intact. The risk of damaging components of the middle ear, inner ear and facial nerve during implantation is greatly reduced.

DETAILED DESCRIPTION OF THE PREFERRED EMBODIMENTS

In the following, the method of the present invention is described by reference to the implantation of a hearing aid. However, it should be noted that the method equally applies for cases in which the system to be implanted performs the function of a tinnitus masker, either in addition to its function as hearing aid, or merely as a tinnitus masking device which does not provide for any further functions which would improve hearing.

Figure 1:
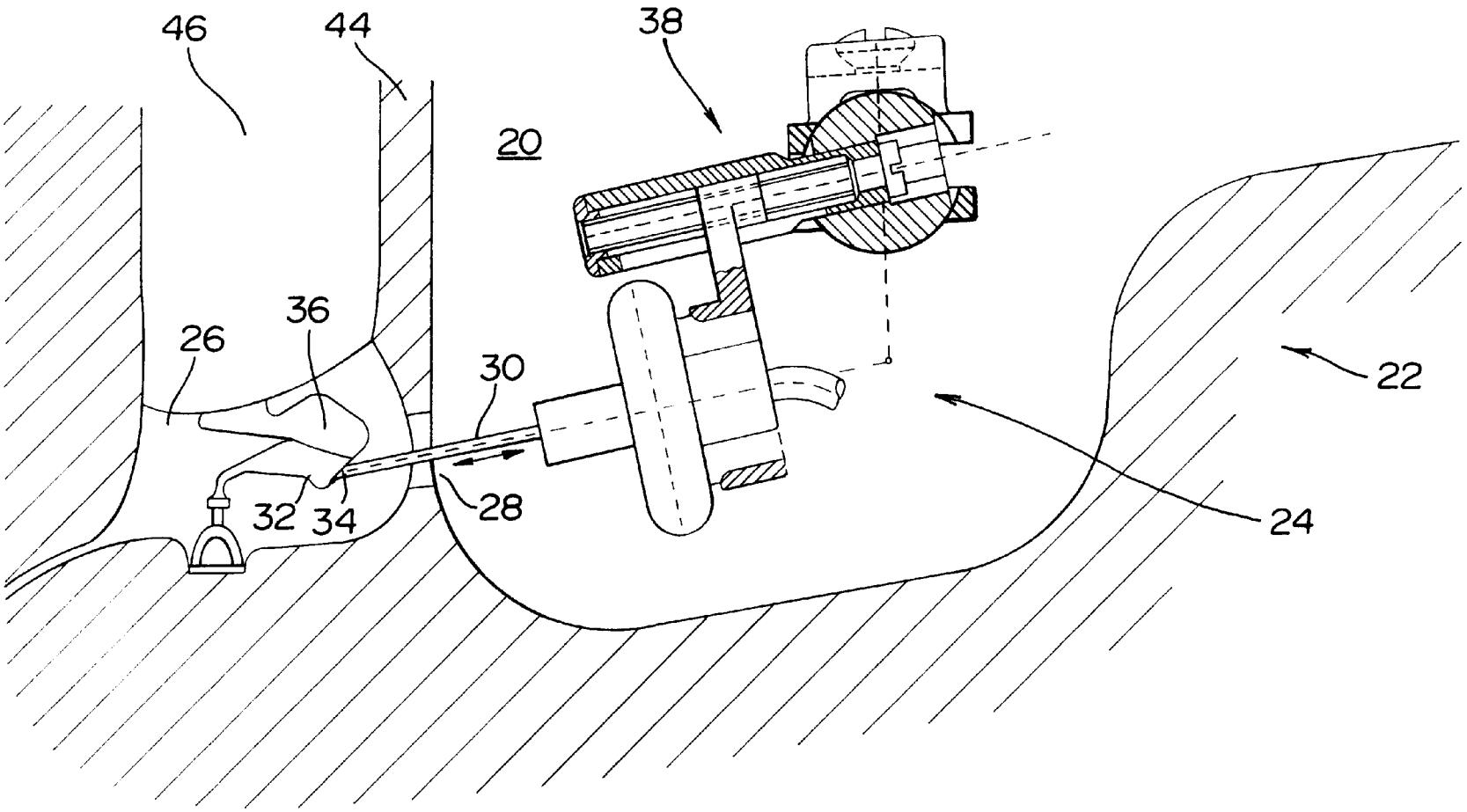
FIG. 1 shows a schematic view of an implantable hearing aid and/or tinnitus masker transducer which has been implanted in accordance with the method of the present invention.
Figure 2:
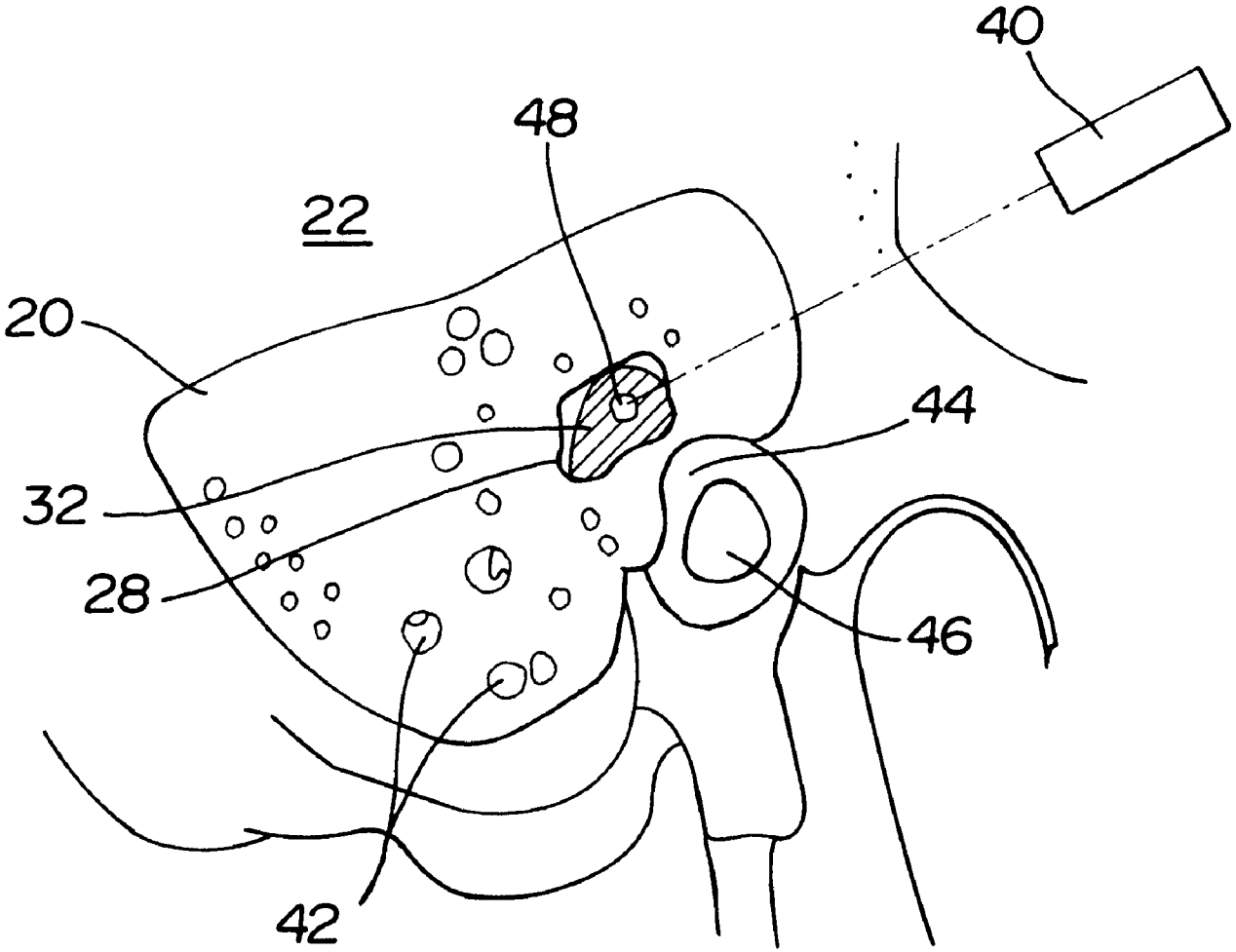
FIG. 2 shows a schematic view of the access to the body of the incus via the natural passage through the aditus ad antrum from the mastoid side after having performed a mastoidectomy in accordance with the method of the present invention.

A retroauricular U-shaped incision is made and a total mastoidectomy (removal of the pneumatised cells of the mastoid) is performed. FIG. 2 illustrates a view of a mastoid cavity 20 within the temporal bone 22 of the patient after having performed said total mastoidectomy during which pneumatised cells 42 are removed and the posterior wall 44 of the auditory canal 46 is exposed. After having provided enough space for mounting the hearing aid or tinnitus masker transducer 24 (illustrated in FIG. 1 only) in the mastoid cavity 20, the connection to the tympanic (middle ear) cavity 26 is prepared by using the aditus ad antrum 28. This is a physiological canal between the superior part of the tympanic cavity 26 and the central cavity (antrum) 20 of the pneumatised cells of the mastoid. It is about 3 to 4 mm long and relatively wide. This physiological connection often provides enough space to expose the body of the incus in the necessary dimension for mechanically coupling the elongated coupling rod 30 of the transducer to the incus 32. In some cases, slightly enlarging the aditus ad antrum may be advisable, especially when the ossicle to be stimulated is the malleus 36. Then, by using transducer positioning and fixing means 38, the transducer 24 is placed in the mastoid cavity 20 such that the elongated transducer coupling rod 30 or the tip 34 thereof, passes through the physiological canal of the aditus ad antrum 28, and the coupling rod 30 or its tip 34 has direct mechanical contact to the ossicle to be stimulated, which in the example shown in FIG. 1 is the body of the incus 32.

A preferred system for placing of the transducer 24 within the mastoid cavity 20 is the positioning and fixing system described in U.S. Pat. No. 5,788,711 which is incorporated herein by reference. The mechanical contact between the tip 34 of the coupling rod 30 and the ossicle to be stimulated can be strengthened by a small amount of an adhesive such as surgical cement. A particularly preferred type of surgical cement for use in the present invention is autologous cement which is formed by bone dust collected during the mastoidectomy and patient's blood or fibrin glue.

In order to provide for improved coupling between the tip of the coupling rod and the ossicle to be stimulated, which may be the incus or the malleus, the ossicle may be provided with a recess 48 wherein which the tip 34 of the transducer coupling rod 30 is received.

In the latter case, the recess 48 is formed prior to fixing the transducer 24 within the mastoid cavity 20. Preferably, the recess is formed by the use of a laser system (in FIG. 2 schematically indicated at 40), most preferably of an Er:YAG laser. By the use of such a laser it is possible to form a receiving recess 48 for example, in the body of the incus 32, by employing a certain number of pulses and small amounts of energy of the individual pulses. The Er:YAG laser being a relatively "cold" laser operating in the middle infrared range with an emission wave length of 2.94 $\mu$m, is ideally suited for treating bones in the thermal sensitive middle ear. Depending on the dimensions of the tip 34 of the coupling rod 30, a preferred range for the diameter of the recess to be formed in the ossicle to be stimulated is from 200 to 700 $\mu$m. In a series of tests, it was found that a series of 15 to 40 individual pulses with an individual pulse energy of between about 25 and about 60 mJ forms a recess in the surface of the ossicle to be stimulated that provides adequate coupling between the tip 34 of the coupling rod 30 and the ossicle.

After positioning the tip 34 of the coupling rod 30 within the artificial recess 48 in the ossicle (incus 32 or malleus 36), the mechanical contact may be strengthened by applying a small amount of static force in direction of the axis of the transducer coupling rod 30. This static force may be produced by slightly pushing the transducer housing using a linear driving mechanism of the transducer positioning and fixing system 38, i.e. described in U.S. Pat. No. 5,788,711. In this case, no adhesive has to be applied to the site of contact between the tip of the coupling rod and the ossicle.

Furthermore, a specifically designed additional coupling element may be provided for coupling the free end of the coupling rod with the ossicle to be stimulated.

While specific preferred embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

What is claimed is:

1. A method for coupling an electromechanical transducer of at least one of a hearing aid and a tinnitus masker which is at least partially implantable to a middle ear ossicle of a hearing impaired person which is to be stimulated, said at least one of a hearing aid and a tinnitus masker including said transducer, a transducer positioning and fixing means, and an elongated coupling rod driven by said transducer, said coupling rod having a tip, the method comprising:

performing a mastoidectomy to provide a mastoid cavity adapted for receiving said transducer of said at least one of a hearing aid and a tinnitus masker;

passing the transducer coupling rod through the natural passage of the aditus ad antrum;

positioning and fixing the transducer of said at least one of a hearing aid and a tinnitus masker transducer within said mastoid cavity with the elongated coupling rod passing through said passage; and contacting the tip of the coupling rod with the ossicle to be stimulated.

2. The method of claim 1 further comprising applying a small amount of static force in the direction of the axis of the transducer coupling rod.

3. The method of claim 1 wherein the coupling rod is connected to the ossicle to be stimulated by applying an adhesive between the tip and the ossicle.

4. The method of claim 3 wherein surgical cement is used as the adhesive.

5. The method of claim 3 wherein autologous cement is used as the adhesive, said autologous cement being formed by bone dust and patient's blood or fibrin glue.

6. The method of claim 1 wherein the coupling rod is contacted with the ossicle by forming a recess in the ossicle to be stimulated and inserting the tip into said recess.

7. The method of claim 6 wherein said recess is formed by directing a laser beam to the surface of the ossicle to be stimulated.

8. The method of claim 7 wherein said laser beam is generated by an Er-YAG laser.

9. The method of claim 7 wherein said laser beam comprises a series of laser beam pulses with an intensity of about 10 to about 100 mJ.

10. The method of claim 6 wherein said recess is formed by providing an indentation having a diameter in the range of about 200 to about 1000 $\mu$m.

11. The method of claim 1 wherein the coupling rod is contacted to the malleus.

12. The method of claim 1 wherein the coupling rod is contacted to the incus.

* * * * *